US006805344B2

(12) United States Patent
Abe et al.

(10) Patent No.: US 6,805,344 B2
(45) Date of Patent: Oct. 19, 2004

(54) AUTOMATIC BANK NOTE PUSHING DEVICE FOR A STORING DEVICE

(75) Inventors: Hiroshi Abe, Iwatsuki (JP); Joji Iida, Hachiouji (JP)

(73) Assignee: Asahi Seiko Co., Ltd., Tokyo (JP)

( * ) Notice: Subject to any disclaimer, the term of this patent is extended or adjusted under 35 U.S.C. 154(b) by 224 days.

(21) Appl. No.: 10/270,971

(22) Filed: Oct. 15, 2002

(65) Prior Publication Data

US 2003/0080495 A1 May 1, 2003

(30) Foreign Application Priority Data

Oct. 16, 2001 (JP) ..... 2001-318229

(51) Int. Cl.[7] ..... G07D 1/00

(52) U.S. Cl. ..... 271/157; 271/100; 271/145; 271/147; 271/181; 235/379

(58) Field of Search ..... 271/3.14, 145, 271/147, 157, 160, 220, 181; 235/379

(56) References Cited

U.S. PATENT DOCUMENTS 4,000,892 A 1/1977 Novak et al.
4,512,263 A 4/1985 Lanning
4,678,072 A * 7/1987 Kobayashi et al. ..... 194/206
5,372,361 A * 12/1994 Isobe et al. ..... 271/181
5,509,646 A * 4/1996 Chang ..... 271/177
5,641,157 A 6/1997 Mays et al.
5,662,202 A * 9/1997 Suris ..... 194/206
5,730,271 A * 3/1998 Buchman et al. ..... 194/206
5,876,033 A * 3/1999 Lonati ..... 271/298
6,244,589 B1 * 6/2001 Gerlier ..... 271/177
6,659,452 B2 * 12/2003 Abe et al. ..... 271/181
2003/0062667 A1 * 4/2003 Saltsov et al. ..... 271/3.14
2003/0080488 A1 * 5/2003 Abe et al. ..... 271/3.14

FOREIGN PATENT DOCUMENTS

JP 4-341473 11/1992

* cited by examiner

*Primary Examiner*—Patrick Mackey

(57) ABSTRACT

An automatic bank note pushing device is movably mounted for extending into and out of a bank note storing holder that in turn is slidably mounted in a bank note storing device or safe. The pushing member can retract from the bank note storing holder when the lid is open to enable the bank note storing holder to be slid out. The pushing member can be activated to extend into the bank note storing holder to bias a stack of bank notes to a discharge position when the lid is closed.

7 Claims, 4 Drawing Sheets

AUTOMATIC BANK NOTE PUSHING DEVICE FOR A STORING DEVICE

BACKGROUND OF THE INVENTION

1. Field of the Invention

This invention relates to a pushing or biasing device which pushes a stack of bank notes in a bank note storing device to a let off device for releasing individual bank notes. More especially, the pushing device automatically is enabled to push the bank notes, when the bank note storing device is either inserted into or out of the storing device.

2. The Description of Related Art

Small bank note dispensing devices are known. Japanese Laid Open Patent Application No. 4-341473 discloses a pushing board to bias bank notes to a separating board by a spring. The bank notes are stored in a bank note storing device and can sometimes become stuck.

"Bank note" as used in this specification can embrace a check, a certificate, a coupon or similar substance of value.

When the bank note storing device is inserted onto the body of a bank note dispensing device, a pushing can board can push the bank notes to a let off device by gravity, because forces generated by a spring can be released by an actuator. Also, when the bank note storing device is removed from the body, the spring forces can be applied to the pushing board.

The prior art generally uses as actuator which is a electric motor to automatically release the force of the spring from the pushing board. When such an actuator is used, the operation can be jammed if the electrical connection is disturbed. Also, the bank note storing device can't be miniaturized, because the actuator is also attached in the bank note storing device. Thus, the prior art is still seeking to improve the cost and efficiency of prior art pushing devices.

SUMMARY OF THE INVENTION

A purpose of this invention is to eliminate a motor-driven actuator and to have a pushing board automatically push against and be released from the bank notes;

Another purpose of this invention is to miniaturize the size of the pushing board;

A third purpose of this invention is to reduce the cost of the pushing board;

An automatic bank note pushing device for a bank note storing device includes a bank note storing device which has a lid and a separating board which can separate a storing section of a bank note holder, a pushing board which is located in the storing section, a first urging device which can urge the pushing board to one side of the separating board, a second urging device which can urge the pushing board to move away from the separating board and is larger than the force of the first urging device, and a release device which can expand or retract the second urging device upon movement of a cover or lid member.

In this structure, the bank notes are placed in the bank note holder, and afterwards the lid is closed. When the lid closes, the second urging device is retracted by the release device with the closure of the lid. In this situation, the pushing board is moved towards the separating board by the first urging device, therefore the bank notes are automatically pushed by the pushing board. Afterwards, the bank note storing device can be inserted into a vending machine or ATM. When the bank notes are dispensed, the pushing board pushes the bank notes with a predetermined force to the let off device, to assist in the release of individual bank notes.

When the lid is opened to remove or for replenishing of bank notes, the pusher is driven away from the separating board by the second urging device, because the second urging device becomes operative when the lid is opened. Therefore, the work for redemption from the bank note holder or replacement to the bank note holder can be easy.

An automatic bank note pushing device for a bank note storing device comprises a bank note storing device which has a top board, a lid, a separating board which can separate a storing section of the bank note holder, a slider which can slide on the top board, a parallel link mechanism which can slide one of a pair of shafts along the longitudinal direction of the top board, a pushing board which is attached to the parallel link mechanism and is located in the storing section, a first spring which is hooked between the top board and the shaft and urges the pushing board to the separating board, a second spring which is hooked between the slider and the bank note storing device and urges the slider in a predetermined direction and provides a larger force than the force of the first spring, a wire which is fixed to one end at the slider and is fixed to another end at the parallel link mechanism, and a lever which slides the slider along the top board and operatively connects with the lid.

In this structure, after the bank notes are placed in the bank note holder, the lid is closed by an operator. Therefore, the lever is pivoted by the lid and the slider moves in opposition to the force of the second spring.

The pushing board is moved towards the side of the separating board by gravity and the force of the second spring. Therefore, bank notes are automatically pushed by the pushing board, because the parallel link mechanism doesn't receive any effect from the slider. In this situation, the bank note storing device can be put in a vending machine or a money exchange machine.

The pushing board helps to let off the bank notes by gravity and the force of the second spring. When the lid is opened to resupply bank notes, the slider slides opposite to the direction of the second spring, because the lever doesn't receive an urging force from the lid in conjunction with the opening of the lid.

Therefore, the pushing board automatically goes away from the separating board, because a wire is drawn and the parallel link mechanism is compressed by the slider. Therefore, the bank notes can be resupplied without any interference from the pushing board.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENT

The following description is provided to enable any person skilled in the art to make and user the invention and sets forth the best modes contemplated by the inventors of carrying out their invention. Various modifications, however, will remain readily apparent to those skilled in the art, since the general principles of the present invention have been defined herein specifically to provide a mechanical automatic banknote pushing device for a safe.

Figure 1:
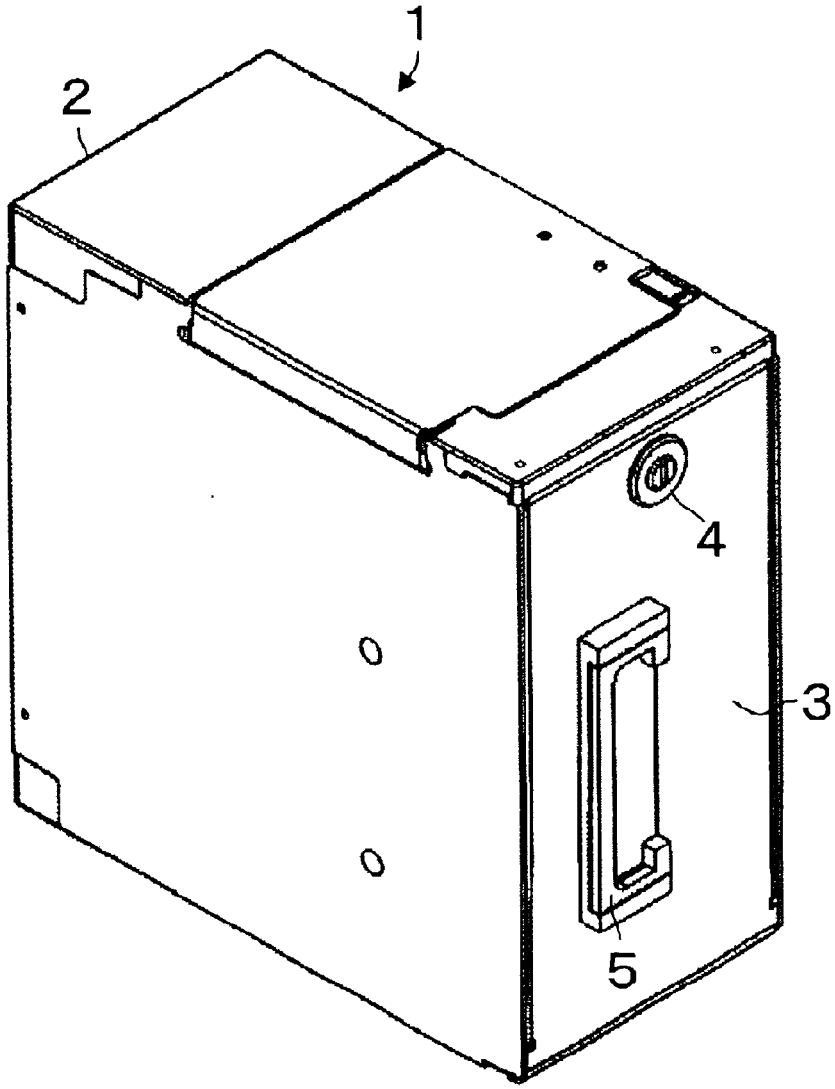
FIG. 1 is perspective view of a bank note storing device of the present embodiment.

The bank note pushing device of the present invention is installed within a bank note storing device 1 of a bank note dispenser, e.g., for use in a vending machine or a change machine (shown in FIG. 1). Bank note storing device 1 can be opened and closed by a lid 3 which has hinges on the lower section at case 2.

Lid 3 is locked to case 2 by a lock member 4 which is fixed at the upper section of lid 3. Handle 5 is gate like in shape and is also fixed at lid 3. Therefore, bank note storing device 1 can be transported by an operator. The storing section 6 of the bank note storing device 1 (shown in FIG. 2) is defined by a separating board 7 and a top board 8. Bank note transporting device 10 is attached on top of the separating board 7 and has rollers 9.

Figure 2:
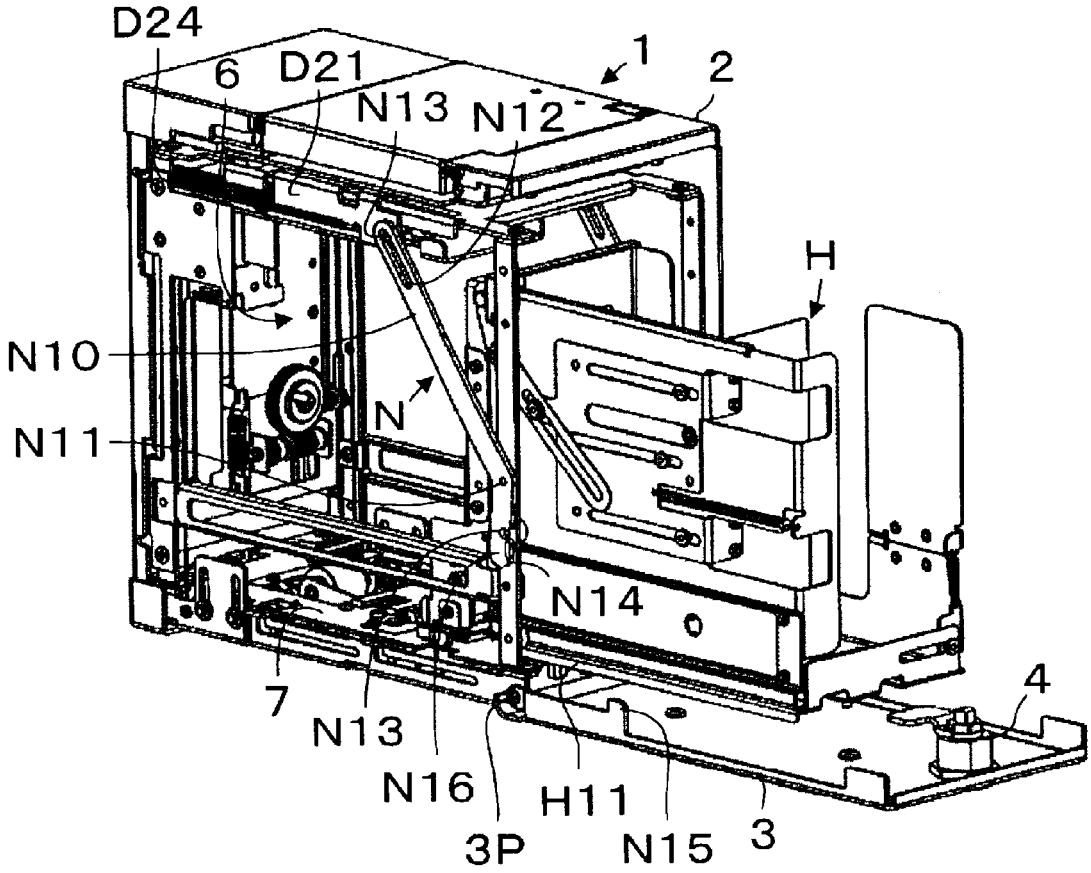
FIG. 2 is perspective view of the bank note storing device without the housing cover and removed from the bank note holding frame.

Next, bank note hold frame H is explained. Bank note holding frame H has a rectangular box shape and includes a sidewall H10 attached on holding board H11 which is a horizontal support structure. Holding board frame H11 can slide along separating board 7 to extend out of storing device 1 (as shown in FIG. 2). Driven rollers 9 make contact with the bank notes in bank note holding frame H through openings in the holding board H11 to release a bank note.

Referring to FIG. 2, the bank note pushing device P includes a parallel link mechanism P10 and a pushing board P30. Parallel link mechanism P10 further includes a first rod P11, a second rod P12, a third rod P13 and a fourth rod P14. The middle sections of first rod P11 and second rod P12 are connected by pivot pin P15 and can pivot about the pin P15. The upper end of first rod P11 can also pivot on a fixed shaft P16 connected to the top board 8.

Guiding board P18 is fixed along top board 8 and has an extended rectangle guiding hole P17. Pin P19 is located at the upper end of second rod P12 and is inserted into guiding hole P17. Third rod P13 is integrated with fourth rod P14 by pin P20 and they can also pivot about pin P20.

The upper end of third rod P13 can pivot on the lower end of the first rod P11 about pin P21. The upper end of fourth rod P14 can pivot on the lower end of the second rod P12 about pin P22. The lower end of third rod P13 can pivot on pin P24 of bracket P23 which is fixed on the upper surface of pushing board P30.

Figure 3:
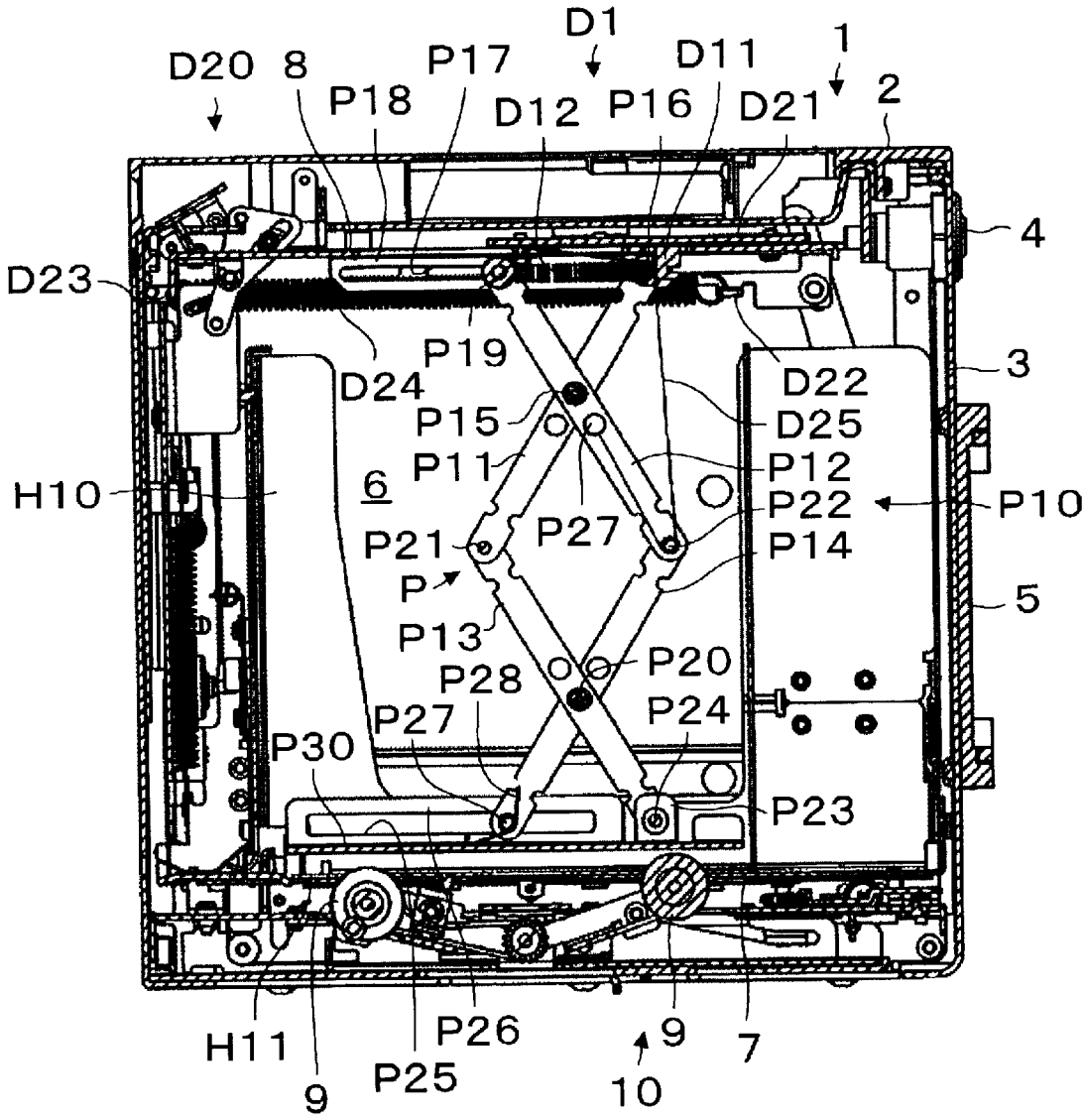
FIG. 3 is cross-sectional view of the bank note storing device.

Guiding board P26 is fixed on the upper surface of the pushing board P30 and has an extended rectangular guiding hole P25. Pin P27 is fixed at the lower end of fourth rod P14 and can slide in guiding hole P25. Pushing board P30 is pivoted in the counterclockwise direction by a spring P28 as shown in FIG. 3. The pushing board P30 is located parallel to holding board H11.

Next, a first urging or biasing device D1 of pushing board P30 is explained. Spring D12 is hooked between a projection D11, which is fixed at the rear surface of top board 8 and a pin P19. First urging device D1 is formed by the spring D12.

Therefore, pin P19 is pulled or biased towards the right as shown in FIG. 3 by the spring D12 and is moved along the guiding hole P17. During the moving of pin P19, second rod P12 pivots in the clockwise direction about pin P15.

Fourth rod P14 also pivots in the counterclockwise direction about pin P20. Therefore, pin P28 will slide toward the right. As a result, parallel link mechanism P10 will extend and push downward the holding board H11.

Figure 4:
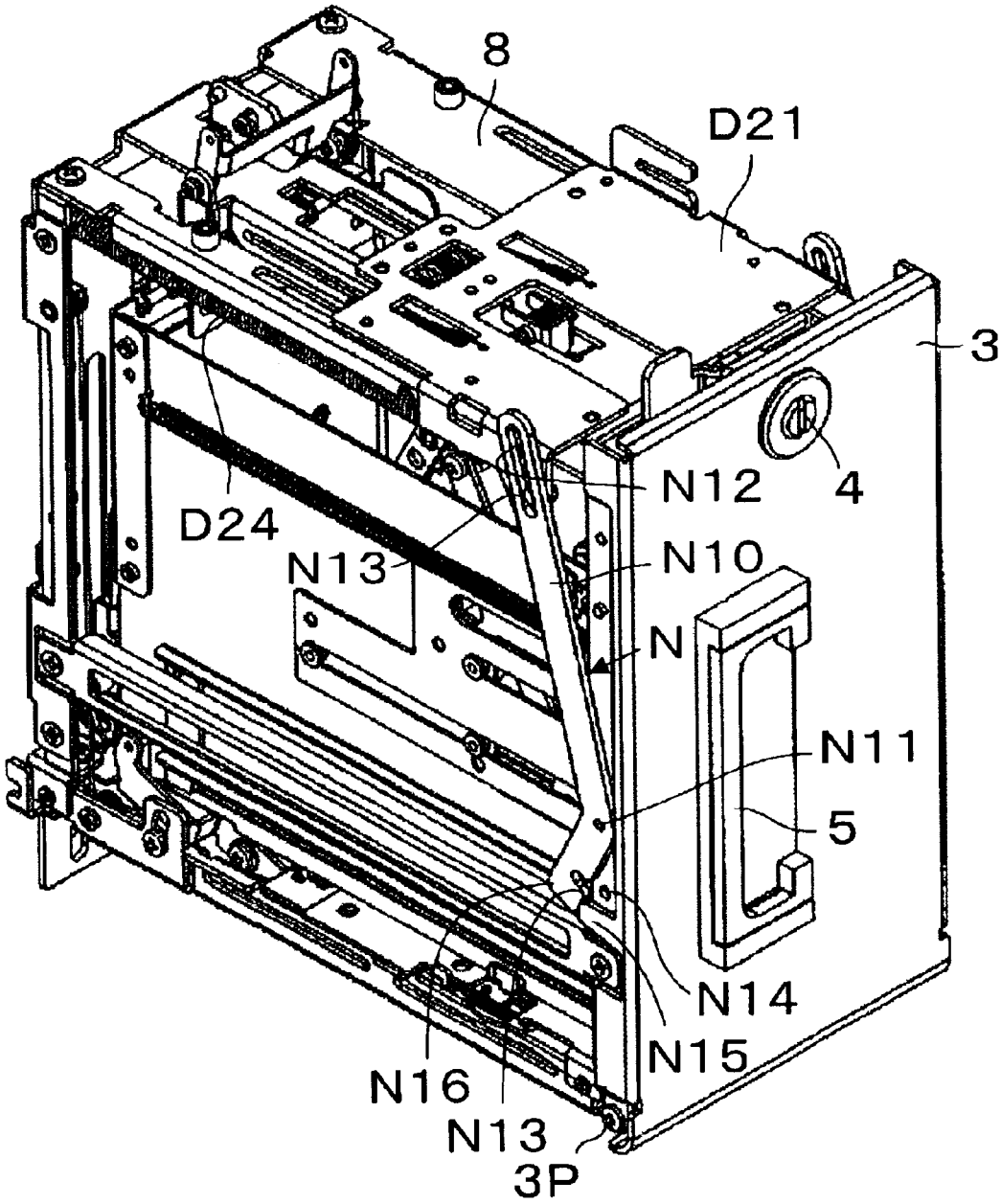
FIG. 4 is perspective view of the bank note storing device without the cover and with the lid closed.

Next, a second urging device D20 is explained. (as shown in FIGS. 2 and 4). Slider D21 has a channel shape in cross-section, and can slide above and along the top board 8. Spring D24 is hooked between a projection D22 which protrudes downwards from the slider D21 and a projection D23 on case 2.

Springs D24 are located at the left and right sides to provide a balance application of forces, however only one spring D24 is shown. The second urging device is spring D24. The force of spring D24 is larger than spring D12.

One end of wire D25 is fixed at the rear surface of slider D21 near the pin P19 by a screw D26. Wire D25 has contact with pin P16 and extends downwards and also has sliding contact with pin P22 and is fixed at second rod P12 near pin P15 by a fastener screw P27.

In this structure, when slider D21 is drawn to the left, as shown in FIG. 3, by spring D24, pin P22 is pulled upward by wire D25. Therefore, pushing board P30 is also pulled upward, because the parallel link mechanism P10 is contracted to become short in length. Wire D25 call be changed to be a rope or a chain.

Next, a release device N is explained, as shown in FIGS. 2 and 4. Lever N10 is boomerang like in shape and can pivot on pin N11 which is fixed at case 2. Levers 10 are located respectfully at the left and right side of case 2, however only one lever 10 will be explained because they both have the same function.

Pin N13 protrudes from the side of slider D21 and can slide in the elongated hole N12 at the upper section of lever N10 (see FIG. 4). U-shaped groove N13 at the lower section of lever N10 has contact with a pin N14 which protrudes from the case 2. Therefore, when U-groove N13 is stopped by pin N14, the lower end of lever N10 doesn't protrude out of the side of case 2.

Projection N15 is fixed to extend towards the side of lever N10 at a side edge of lid 3. When lid 3 is closed, projection N15 has contact with the lower section N16 of lever N10 and pushes it into the inside of case 2. In this process, lever N10 is pivoted in the clockwise direction and slides pin N13 to the right (as shown in FIG. 4).

By the sliding of pin N13, slider D21 is moved to the right. Therefore, the parallel link mechanism P10 can be extended because the distance between screw D26 and pin P16 becomes shorter. As a result, pushing board D30 is moved downward by gravity and the force of spring D12 to push the bank notes to the side of the separating board 7 and also holding board H11 and bank note let off device 10.

Next, the operation of this embodiment is explained. When lid 3 is closed, lower edge N16 of lever N10 is pushed by projection N15 and lever N10 is pivoted in the clockwise direction about pin N11. Therefore, slider D21 is moved to the right through contact of pin N13 with lever N10.

As a result, the distance between screw D26 and pin P16 is lesser and pushing board P30 pushes the bank notes toward holding board H11 and bank note let off device 10 by both gravity and the force of spring D12, as shown in FIG. 3.

Next, an operation which puts bank notes into the storing section 6 is explained. The lock 4 is unlocked and afterwards lid 3 is opened. Therefore, projection N15 stops pushing against the lower end N16 of lever N10. As a result, slider D21 is moved from the position shown in FIG. 3 to the left by the force of spring D24. Screw D26 moves in the same direction, and as a result, the distance between screw D26 and pin P16 is extended and wire D25 is drawn upward.

Pin P22 is pulled up by wire D25 and the parallel link mechanism P10 is contracted and rises up towards the top board 8. Also, pushing board P30 is automatically drawn up to a portion near top board 8 and releases contact with the bank notes. Next, holding frame H is drawn out from the storing section 6 and the bank notes can be resupplied free of pushing board P30. Afterwards, holding frame H is re-inserted into the storing section 6 and lid 3 is closed and is locked by lock 4.

With the closing motion, projection N15 pushes the end N16. Therefore lever N10 is pivoted in the clockwise direction. Slider D21 slides to the right in conjunction with the movement through pin N13. Therefore, spring D24 is render ineffective. As a result, the distance between screw D26 and pin P16 becomes short, and the parallel link device P can be extended. Pushing board P30 is moved downward by gravity and the force of spring D12 to automatically push against the bank notes to bias them against roller 9.

In this specification, "horizontal" and "vertical" are conveniently used, however the full advantages of the present invention are not limited by the drawings. For example, the first urging device can be structured for operation by only gravity.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An automatic bank note pushing device for a bank note storing device comprising:

a bank note storing device having a lid, a separating board and a bank note holder storing section;

a pushing board is extending into the storing section;

a first urging device can urge the pushing board towards the separating board;

a second urging device can urge the pushing board away from the separating board at a larger force than the force of the first urging device; and a releasing device is operatively connected to respond to an opening movement of the lid for controlling the application of the second urging device.

2. An automatic bank note pushing device for a bank note storing device comprising:

a bank note storing device having a storing section, a top board, a lid and a separating board;

a slider movably attached to the top board;

a parallel link mechanism which is mounted for relative movement along a longitudinal direction of the top board;

a pushing board which is attached to the parallel link mechanism and is extendible into the storing section;

a first spring member which is connected to the top board for using the pushing board towards the separating board;

a second spring member which is connected between the slider and the bank note storing device for urging the slider in a predetermined direction with a force larger than the force of the first spring member;

a flexible member which is fixed to one end of the slider and is fixed at another end on the parallel link mechanism; and a lever which slides with the slider along the top board and is operatively connect with the lid to control the application of force of the second spring member.

3. In a device for holding a stack of bank notes for individual dispensing, the improvement of:

a bank note storing device having a housing with a movable lid;

a bank note storing holder movably mounted to the bank note storing device for extending into and out of the housing when the lid is open to receive bank notes;

a pushing member movably mounted in the housing to extend into and out of the bank note storing holder for biasing the bank notes towards an exit opening in the housing; and a release mechanism operatively connected with the lid when in a closed position on the housing to release the pushing member to extend into the bank note storing holder.

4. The device of claim 3 wherein the release mechanism includes a lever member and a first spring member for biasing the pushing member to a position out of the bank note storing holder, wherein the lever can override the application of force from the first spring member.

5. The device of claim 4 further including a second spring member for biasing the pushing member against the bank notes in the bank note storing holder with a lesser force than the force that can be created with the first spring member.

6. The device of claim 5 further including a parallel link mechanism for movably supporting the pushing member.

7. The device of claim 6 further including a slider member and a flexible connector, the flexible connector is connected to the slider member and the parallel link mechanism for retracting the parallel link mechanism upon application of the force of the first spring member to the slider member.

* * * * *